United States Patent [19]

Hamano

[11] 4,329,674

[45] May 11, 1982

[54] HIGH VOLTAGE TRANSFORMER FOR AC-DC CONVERTER

[75] Inventor: Tadayasu Hamano, Yamato, Japan

[73] Assignee: Tokyo Shibaura Denki Kabushiki Kaisha, Kawasaki, Japan

[21] Appl. No.: 184,263

[22] Filed: Sep. 5, 1980

[30] Foreign Application Priority Data

Sep. 10, 1979 [JP] Japan ..... 54-115253

[51] Int. Cl.[3] ..... H01F 21/12; H01F 27/28

[52] U.S. Cl. ..... 336/92; 336/150; 336/170; 336/180; 336/184; 363/68

[58] Field of Search ..... 323/247, 251, 253, 346, 323/328; 363/68, 35; 336/90, 92, 5, 10, 12, 150, 180, 182, 183, 184, 170, 171

[56] References Cited

U.S. PATENT DOCUMENTS 1,749,388 3/1930 Meyerhans ..... 336/184 X 3,611,232 10/1971 Sakamoto ..... 336/184 X

FOREIGN PATENT DOCUMENTS 53-136622 11/1978 Japan ..... 336/184

OTHER PUBLICATIONS

Proc. Can. Communication EHV Conf. Montreal, "Design and Testing of the Eel River HV DC Converter Transformers", by L. B. Strickland and B. C. Olsen, 1972, pp. 147–148.

*Primary Examiner*—Thomas J. Kozma

*Attorney, Agent, or Firm*—Oblon, Fisher, Spivak, McClelland & Maier

[57] ABSTRACT

A converter transformer for an AC-DC converter is assembled by connecting three transformer units at an installment site. In the respective transformer units, first, second and third iron core legs are received in oil tanks. On the first and second core legs are mounted series-connected first and second primary windings, respectively. On the second and third legs are mounted first and second secondary windings respectively. Coupling windings connected in parallel are mounted on the respective legs. The primary windings and the secondary windings are electromagnetically coupled.

10 Claims, 13 Drawing Figures

1.0
0.5
0
-0.5
-1.0
82
84
88
90
92
100
102

HIGH VOLTAGE TRANSFORMER FOR AC-DC CONVERTER

The present invention relates to a high voltage transformer for an AC-DC converter and, more particularly, to a transformer unit therefor.

A high voltage DC converter transformer (to be referred to as an HVDC converter transformer for brevity hereinafter) is generally arranged in a frequency converter with a DC link for interconnecting electric power transmission systems, each transmitting electric powers of different frequencies, or in an AC-DC converter in a high voltage DC transmission system. An example of such a DC converter is schematically shown in the single-line diagram of FIG. 1. The converter shown in this figure converts by 12-phase rectification a three-phase AC voltage supplied to a three-phase AC input line 2 to a high DC voltage and supplies it to its DC lines 4, 6. Thus, the three-phase high AC voltage is supplied to a first section 12 comprising a first high voltage transformer 8 and a first thyristor group 10 and to a second section 18 comprising a second high voltage transformer 14 and a second thyristor group 16 and the both high AC voltages supplied to the two sections are each converted by 6-phase rectification to the high DC voltage. As shown in the figure, at the first high voltage transformer 8, AC side primary windings 20 are star- or Y-connected; DC side secondary windings 22 are similarly star- or Y-connected; and tertiary windings 24 are delta- or Δ-connected. In the second high voltage transformer 14, AC side primary windings 28 are star- or Y-connected and DC side secondary windings 30 are delta- or Δ-connected.

The three-phase transformers 8, 14 of this type must satisfy the following conditions:

(1) In FIG. 2 showing an equivalent circuit of the converter shown in FIG. 1, the relation $Z1+Z2=Z4$ must be satisfied for equivalent impedances Z1, Z2, Z3 and Z4 representing the impedances between the windings 20, 22, 24, 28 and 30 of the transformers 8, 14. This is to prevent enlargement of the equipment for removing the ripple in the converted high DC voltage.

(2) In an equivalent circuit (not shown) which is obtained by star-converting the impedances distributed between AC side terminal 32 and DC side terminals 35, 37, the equivalent impedance at the AC side is required to be sufficiently small, preferably being zero. This is to prevent fluctuation of the DC supply voltage which may be caused by loads connected to the DC side terminals 35, 37.

(3) An ultra-high voltage three-phase transformer is manufactured such that it is usually divided into three single-phase transformer units. The reason for this is (1) to meet the transportation requirements and (2) to readily attain an insulation clearance between bushings. Accordingly, three-phase transformer is divided into single-phase transformer units in a factory and the single-phase transformer units are transported to a site where a three-phase transformer bank is assembled with these three single-phase transformer units. However, such single-phase transformer units are also required to be within the transportation limits.

A conventional single-phase transformer unit 38 for assembling the three-phase transformers 8, 14 which satisfies the above-mentioned requirements has a construction as shown, for example, in FIGS. 3 and 4. The single-phase transformer unit 38 illustrates an example where two single-phase transformers 40, 42 are assembled. The single-phase transformer 40 corresponds to one phase part of the first three-phase transformer 8 in FIG. 1, and the single-phase transformer 42 corresponds to one phase part of the second three-phase transformer 14 in FIG. 1. In an iron core 44 encased in an oil tank 45 of the single-phase transformer unit 38, as shown in FIGS. 4 and 5, are mounted windings 20-1, 22-1 and 24-1 each corresponding to the one phase winding of the primary, secondary and tertiary windings 20, 22 and 24 of the first three-phase transformer 8, respectively, and are mounted windings 28-1 and 30-1 each corresponding to the one phase winding of the primary and secondary windings 28, 30 of the second three-phase transformer 14, respectively. The windings 20-1, 22-1 and 24-1 of the transformer 8 of the first section 12 and the windings 28-1 and 30-1 of the transformer 14 of the second section 18 shown in FIG. 1 are wound on different legs 46, 48 for satisfying the requirements (1) and (2) described above. The windings 20-1, 22-1, 24-1, 28-1 and 30-1 are connected to corresponding terminals 50-1, 50-2, 52-1, 52-2, 54-1, 54-2, 56-1 and 56-2 leading out of the oil tank 45 through bushings. The terminals of the unit 38 are connected at the site to the terminals of two other single-phase transformer units of similar construction so that the windings are delta- or star-connected to the windings of the other units for assembly into a three-phase transformer of one bank.

The single-phase transformer units 38 as shown in FIGS. 3 and 4 do indeed satisfy the conditions (1), (2) and (3) to a certain extent, but have the problems described below.

(i) The insulating distance between the windings wound on a single iron leg becomes greater and, consequently, the width W of the oil tank 45 becomes great. When the power capacity (KVA) of the three-phase transformers 8, 14 becomes greater, the width W may exceed the railroad transportation limit. In FIG. 5 illustrating the transformer unit of FIG. 3 along the line V—V, it is required that the gap d2 between the tertiary winding 24-1 and the secondary winding 22-1, and the gap d3 between the secondary winding 22-1 and the primary winding 20-1, each, have an sufficient insulating distance for the voltage between the DC side secondary winding 22-1 and ground and the gap d3 between the secondary winding 22-1 and the primary winding 20-1, and the gap d4 between the primary winding 20-1 and the inner surface of the oil tank 45, each, have an sufficient insulating distance for the voltage between the AC side primary winding 20-1 and ground. When the AC voltage to be input to the converter transformers 8, 14 or the DC voltage to be output thereafter becomes extremely large, the above-mentioned distances d2, d3 and d4 become substantially the same or several times of the winding thickness. Thus, the width W of the oil tank 45 becomes greater, exceeding the railroad transportation limit and obstructing transportation of the unit.

(ii) As shown in FIG. 5, the distance d6 between a lead line 60-1 extending from the DC side secondary winding 22-1 and the AC side primary winding 20-1, and the distance d5 between the lead wire 60-1 and a clamp 66 for clamping and securing the iron core 44 and the windings are determined by an insulating distance required for the HVDC and HVAC, and the distances d5 and d6 must be sufficiently great. Therefore, when the output DC voltages of the converter transformers 8, 14 become great, the distances d5 and d6 become large and the height of the oil tank 45 becomes greater, so that it becomes hard to keep the transformer unit 38 within the railroad transportation limits. Further, since the lead wire 60-1 must be insulated to the DC high voltage, much labor for insulating the lead wire 60-1 is required.

It is, therefore, the primary object of the present invention to provide a transformer unit for an AC-DC converter which satisfies the impedance requirements of the transformers for the AC-DC converter and which is still capable of being within the width, height and weight limits for transportation.

To the above and other ends, the present invention provides a transformer unit for an AC-DC converter comprising:

a first core leg;

a first winding unit which is mounted on said first core leg and which includes a first primary winding and a first coupling winding electromagnetically coupled to said first primary winding;

a second core leg;

a second winding unit which is mounted on said second core leg and which includes a second primary winding connected in series with said first primary winding, a second coupling winding connected in parallel with said first coupling winding and electromagnetically coupled to said second primary winding, and a first secondary winding electromagnetically coupled to said second primary and coupling windings;

a third core leg; and a third winding unit which is mounted on said third core leg and which includes a third coupling winding connected in parallel with said first coupling winding, and a second secondary winding electromagnetically coupled to said third coupling winding.

This invention can be more fully understood from the following detailed description when taken in conjunction with the accompanying drawings, in which.

Figure 6:
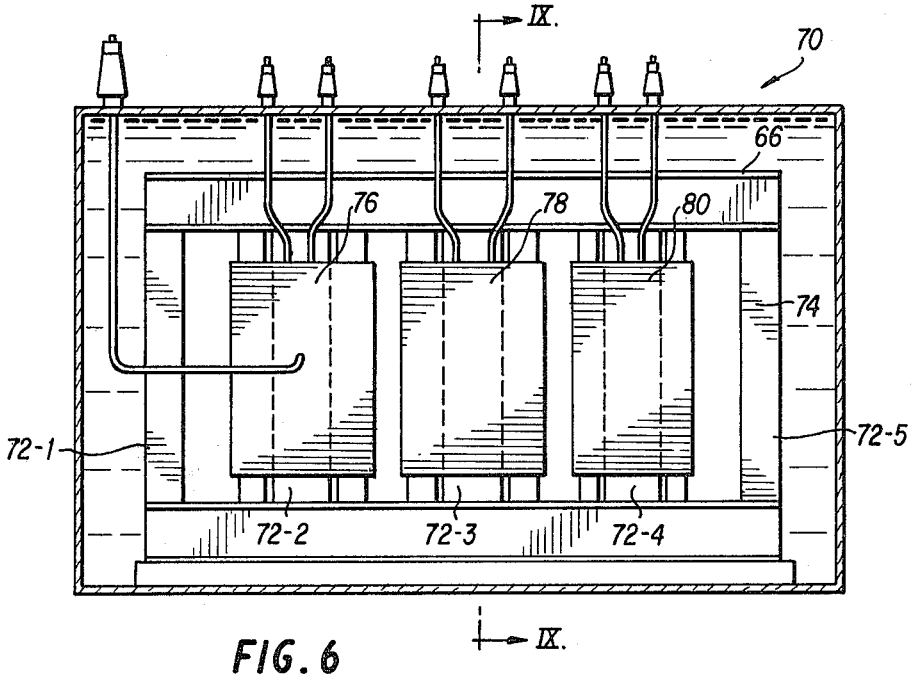
FIG. 6 is a schematic sectional view illustrating a transformer unit in accordance with an embodiment of the present invention.

FIG. 6 shows an embodiment of a single-phase transformer unit 70 for assembly of a transformer for an AC-DC converter according to the present invention. As shown in the figure, in the unit 70, an iron core 74 having five legs 72-1, 72-2, 72-3, 72-4 and 72-5 is received in an oil tank 45. On the three legs 72-2, 72-3 and 72-4 of the iron core 74 are mounted a first winding unit 76, a second winding unit 78, and a third winding unit 80, respectively. These winding units 76, 78 and 80 are fixed to the iron core 74 by a clamp 66.

Figure 7:
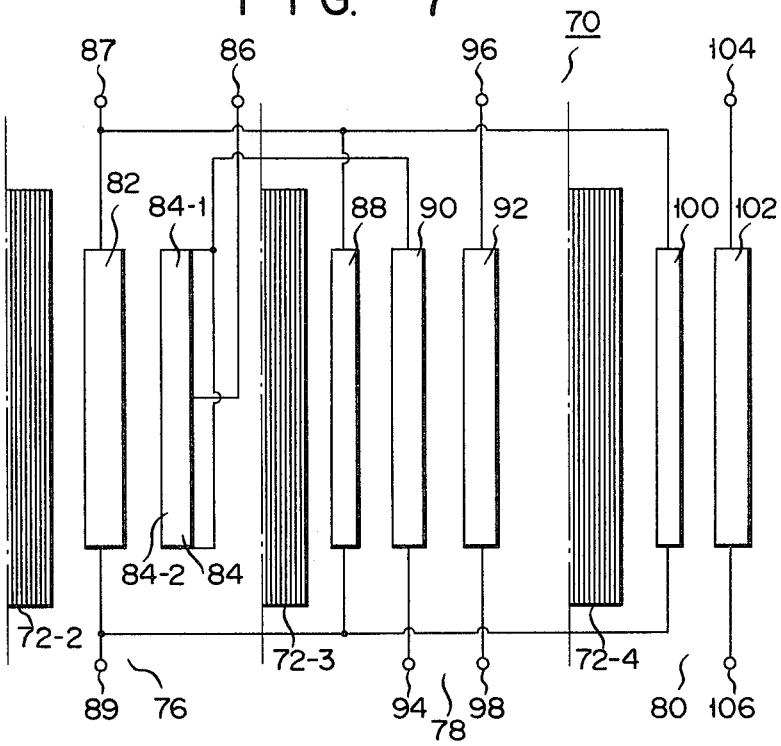
FIG. 7 is a schematic sectional drawing illustrating the arrangement and connection of the windings constituting the winding units included in the transformer unit shown in FIG. 6.

The first winding unit 76, as shown in FIG. 7, comprises a first coupling winding 82 and an AC side first primary winding 84. The first coupling winding 82 is wound, inside the AC side first primary winding 84. A plurality of insulating cylinders are mounted between the first coupling winding 82 and the AC side primary winding 84. The AC side first primary winding 84 is divided into an upper part 84-1 and a lower part 84-2 which are connected in parallel. The middle portion of the first primary winding 84 is connected to a high AC voltage line terminal 86 through a lead wire, and the top and bottom end portions of the main primary winding 84 are mutually connected through the lead wire. The power capacity (KVA) of the first coupling winding 82 is same as that of the first primary winding 84. The second winding unit 78 comprises a second coupling winding 88, an AC side second primary winding 90, and a DC side first secondary winding 92. Inside is wound the second coupling winding 88, outside is wound the DC side first secondary winding 92, and the AC side second primary winding 90 is wound therebetween. A plurality of insulating cylinders are interposed between each pair of windings. The second coupling winding 88 is connected in parallel with the first coupling winding 82 of the first winding unit 76 through a lead wire; the top end portion of the second primary winding 90 is connected to the common connection point of the first primary winding 84 through a lead wire; and the bottom end portion of the second primary winding 90 is connected to a neutral point terminal 94 through a lead wire. The DC side first secondary winding 92 is connected to DC side line terminals 96 and 98. The power capacity of the second coupling winding 88 is same as the difference between the power capacities of the DC side first secondary winding 92 and the AC side second primary winding 90. In other words, the sum of the power capacities of the second coupling winding 88 and the AC side second primary winding 90 is same as the DC side first secondary winding 92. The third winding unit 80 comprises a third coupling winding 100 and a DC side second secondary winding 102. The DC side second secondary winding 102 is wound at the outside of the third coupling winding 100. A plurality of insulating cylinder are mounted between the second secondary winding 102 and the third coupling winding 100. The third coupling winding 100, as in the case of the second coupling winding 88, is connected in parallel with the first coupling winding 82 through a lead wire, and the second secondary winding 102 is connected to DC side line terminals 104 and 106 through lead wires. The power capacity of the third coupling winding 100 is same as that of the secondary winding 102.

Figure 8:
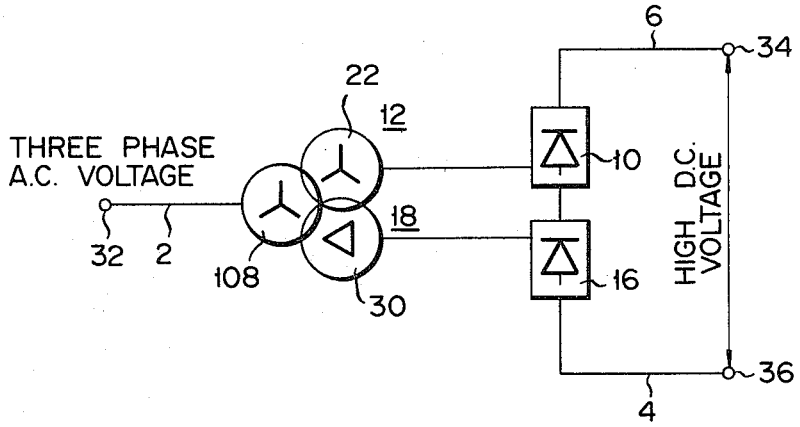
FIG. 8 is a schematic single-line diagram illustrating an AC-DC converter including a converter transformer which is assembled by the three transformer units shown in FIG. 6.

Three of the transformer units 70 as described above are manufactured at a factory in advance. These three units are transported to the site and are assembled into a converter transformer as shown in FIG. 8. The second secondary windings 102 of a first sections 12 are star-connected through the terminals 106, and the first secondary windings 92 of a second sections 18 are similarly delta-connected through the line terminals 96, 98 for forming secondary windings 22, 30 of the two sections of the converter transformer. Neutral point terminals 94 are commonly connected and each of the line terminals 86 is connected to the three-phase AC lines respectively. Series-connected first and second primary windings 84, 90 are star-connected for forming primary windings 108 of the converter transformer. For connecting a tertiary load to the converter transformer, lead wires are extended, as shown in FIG. 7, from the top and bottom end portions of the coupling winding 82 for connection with tertiary terminals 87, 89 outside the unit 70. These terminals 87, 89 are delta-connected to the corresponding terminals of the other transformer units, and to the tertiary load. In this case, the power capacity of respective coupling windings 82, 88 is determined to be larger than the values mentioned above.

In each transformer unit 70 of such a converter transformer, when one phase component of the three-phase AC electrical voltage is supplied between the AC line terminal 86 and the neutral point terminal 94, the first and second primary windings 84, 90 are excited. By the second primary winding 90, the DC side first secondary winding 92 and the second coupling winding 88 of the second section 18 are excited and a converted voltage is generated across the DC side terminals 96, 98 of the first secondary winding 92. The first coupling winding 82 is excited by the first primary winding 84, and the third coupling winding 100 is excited by the excited first and second coupling windings 82, 88. As a result, the second secondary winding 102 of the first section 12 is excited, and a converted voltage is induced across the DC side terminals 104, 106.

Figure 5:
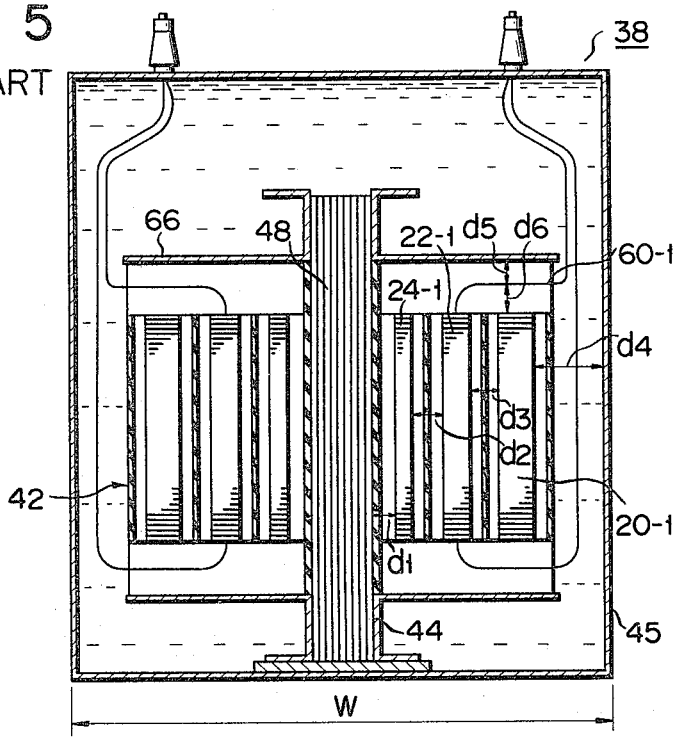
FIG. 5 PRIOR ART
FIG. 5 is a vertical sectional view along the line V—V of FIG. 3.
Figure 4:
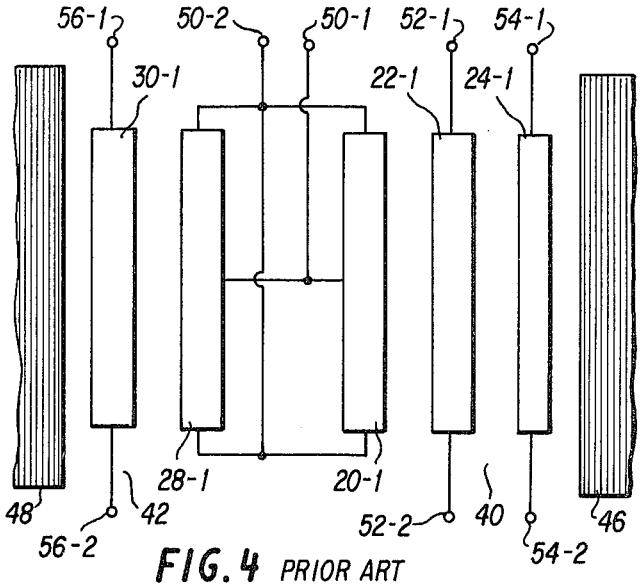
FIG. 4 PRIOR ART
FIG. 4 is a schematic sectional drawing illustrating the arrangement and connection of the windings constituting the winding units shown in FIG. 3.
Figure 9:
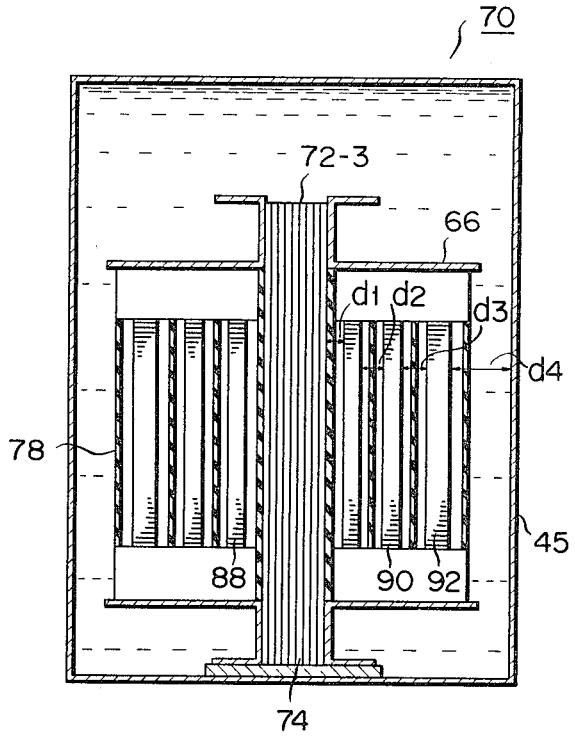
FIG. 9 is a sectional view along the line IX—IX of FIG. 6.

In the transformer unit 70 of the type described, various requirements as mentioned hereinbefore with regard to the background of the invention can all be satisfied. First, the width W of the oil tank 45 can be kept within the transportation limit. Three windings 88, 90 and 92 are wound on the third core 72-3. The second primary winding 90 is connected to the neutral point terminal 94 and is connected in series with the first primary winding 84 so that the potential of the top end of the winding 90 is low, for example, the potential of the top end of the second winding 90 is substantially half of that of the middle portion of the first winding 84. Further, the terminals 96, 98 of the first secondary winding 92 are connected to the low potential side as shown in FIG. 8. Thus, even if three windings 88, 90 and 92 are wound on a single core 72-3, the distances d1, d2, d3 and d4 between the windings need not become very great as shown in FIG. 9. Two windings 82, 84 are wound on the second core 72-2, and the winding 84 is connected to the terminal 86 of high potential. However, since only two windings are wound, sufficient insulating distance can be secured between the windings without the outer diameter of the outer winding 84 becoming very big. Similarly, the two windings 100, 102 are wound on the fourth core 72-4, and the secondary winding 102 is connected to the high potential side. For same reason described above, the outer diameter of the outer winding 102 does not become very big. Further, since the DC side secondary windings 92, 102 are wound on the outside, insulation of the lead wires extending from the windings 92, 102 is relatively easy, so that the height of the oil tank 45 need not be made very great. For example, when the power capacity ratio of the AC side primary windings 84 and 90 is set to be substantially 1:1, the power capacities of the primary winding 84 and the DC side secondary winding 102 becomes substantially equal. Accordingly, the outer diameters of the two high potential windings 84, 102 become substantially equal. Further, the distance d2 between the second coupling winding 88 and the primary winding 90, the distance d3 between the primary winding 90 and the secondary winding 92, and the distance d4 between the secondary winding 92 and the oil tank 45 may be kept to about half the corresponding distances of the conventional transformer unit 38 as shown in FIG. 5. The outer diameter of the first secondary winding 92 may be made only a little larger than those of the first primary winding 84 and the second secondary winding 102.

An increase in the outer diameter of the first secondary winding 92 does not necessarily mean that the oil tank has to be increased in width. The reason for this is that the distances between the outer surfaces of the windings 84, 102 and the inner surface of the tank 45 should be extended in order to fully insulate said windings 84, 102 which have higher potentials than the second primary winding 90 and the first secondary winding 92 having a lower potential. Therefore, the oil tank can hold the windings 92, 84, 102 with substantially the same margin of insulation. As a result, the winding units 76, 78 and 80 do not take up any excess space so that the winding units 76, 78 and 80 can be arranged efficiently.

Figures 10A, 10B, 10C:
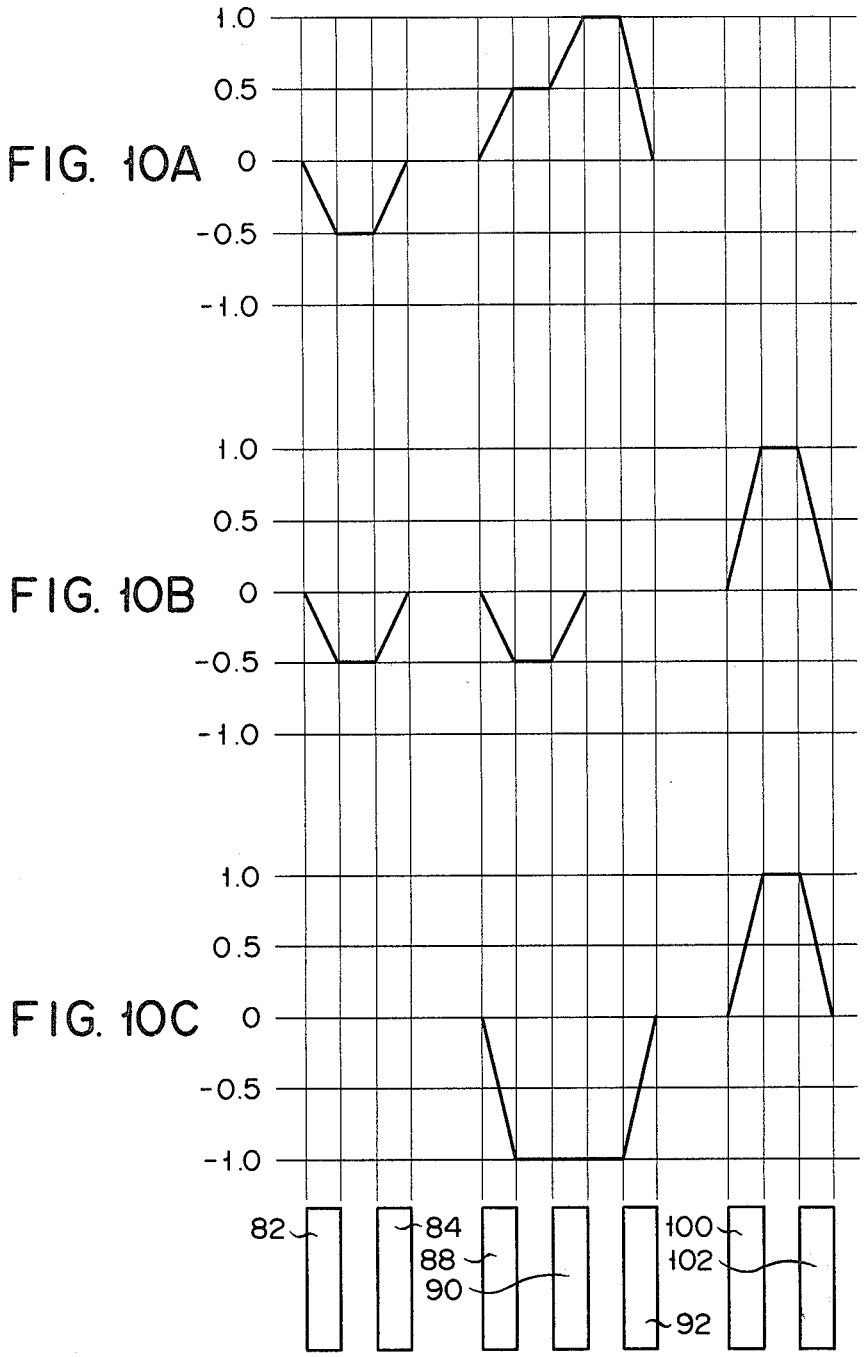
FIGS. 10A, 10B and 10C are ampere-turn distribution graphs of the transformer unit shown in FIG. 6.

In addition, the impedance requirements for the windings of the converter transformer may be satisfied. It is seen from the ampere-turn distribution view shown in FIGS. 10A–10C that this requirement is satisfied. In this ampere-turn distribution view, the reference values up to 1.0 ampere-turn are plotted along the ordinate, and the windings and main gaps are plotted along the abscissa. FIG. 10A shows the ampere-turn distribution for respective windings 82, 84, 88, 90 and 92 when an input voltage is supplied to the primary windings 84, 90, the secondary winding 102 is open, and a load is connected across the secondary winding 92. FIG. 10B shows the ampere-turn distribution of the respective windings when an input voltage is supplied to the primary windings 84, 90, the secondary winding 92 is open, and a load is connected across the secondary winding 102. It further shows the ampere-turn distribution when the primary windings 84, 90 are open, an input voltage is applied to either of the secondary windings 92, 102, a load is connected across the other of the two windings. An integration value obtained by squaring the magnetic flux density B and integrating a resultant value with respect to a distance s is proportional to an impedance Z as given in the following equation.

$$Z \alpha \int B^2 ds$$

Figure 1:
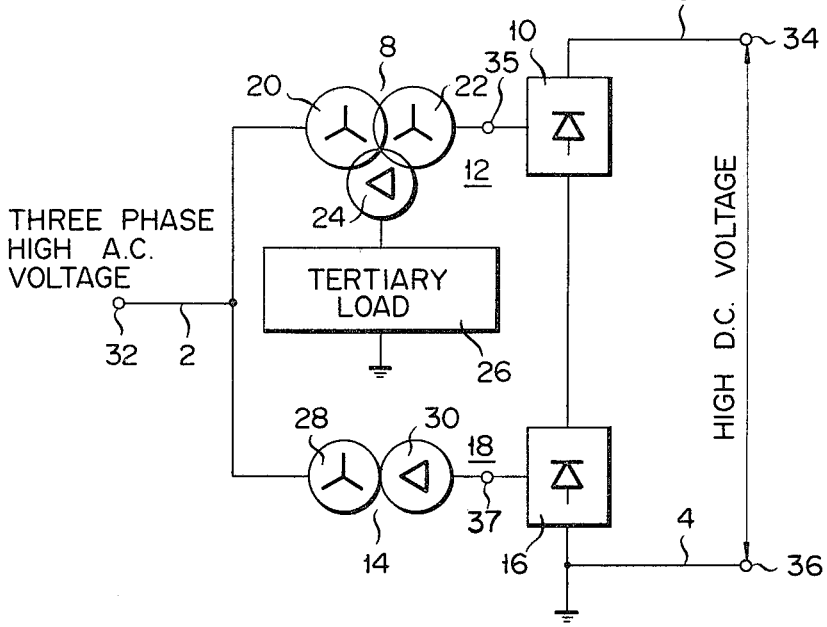
FIG. 1 PRIOR ART
FIG. 1 is a schematic single-line diagram of an AC-DC converter of a general high voltage DC transmission system or a frequency converter system.
Figure 2:
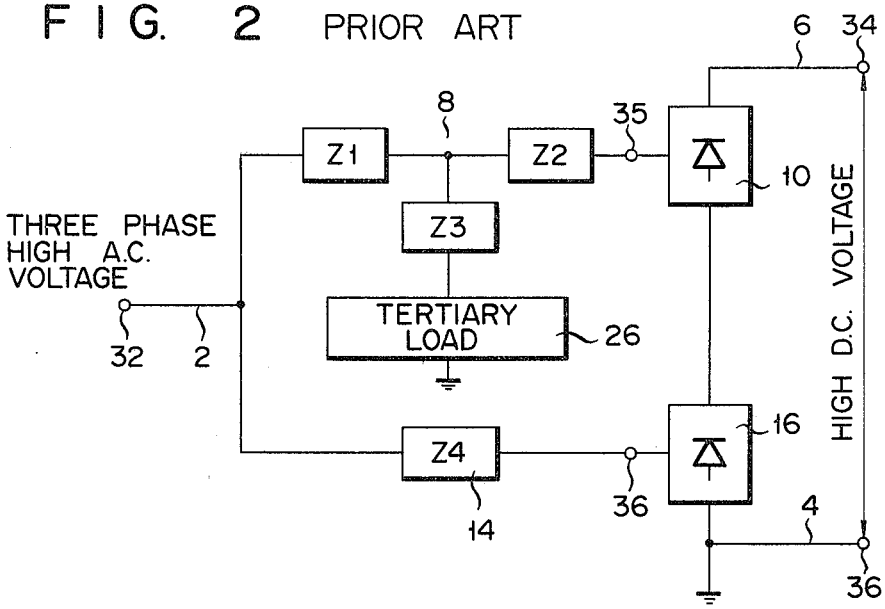
FIG. 2 PRIOR ART
FIG. 2 is an equivalent circuit diagram of the circuit shown in FIG. 1.
Figure 3:
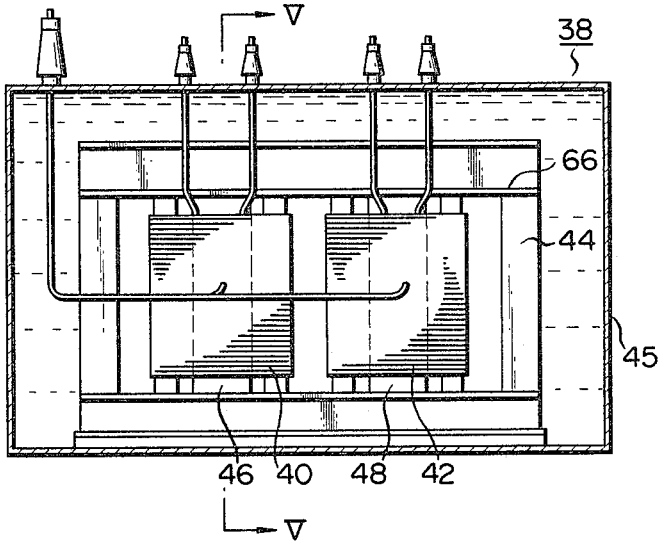
FIG. 3 PRIOR ART
FIG. 3 is a schematic sectional view illustrating an example of one of three conventional single-phase transformer units which are assembled into the converter transformer shown in FIG. 1.

The flux density B is proportional to the ampere-turn (AT). Thus a mutual relation of impedances is evident from the ampere-turn as shown in FIGS. 10A to 10C. Integration values obtained from FIGS. 10A and 10B are equal each other. Thus, the impedance Z12 between the secondary winding 92 and the primary windings 84, 90 is equal to the impedance Z13 between the secondary winding 102 and the primary winding. Further, twice of the integration value obtained from FIG. 10A or 10B is equal to that obtained from FIG. 10C. Consequently, the impedance Z23 between the secondary windings 92, 102 is twice the impedance Z12 or Z13 between the secondary and primary windings. Thus, the relation $Z23=2Z12=2Z13$ is established. When these impedances Z12, Z13 and Z23 are star-converted, the impedance connected to the AC side is $Z11=(Z12+Z13-Z23)/2=0$. Thus, one of the impedance requirements is satisfied. The other impedance requirement described with reference to FIG. 2 may be easily satisfied, since respective windings are wound on different cores.

Figure 11:
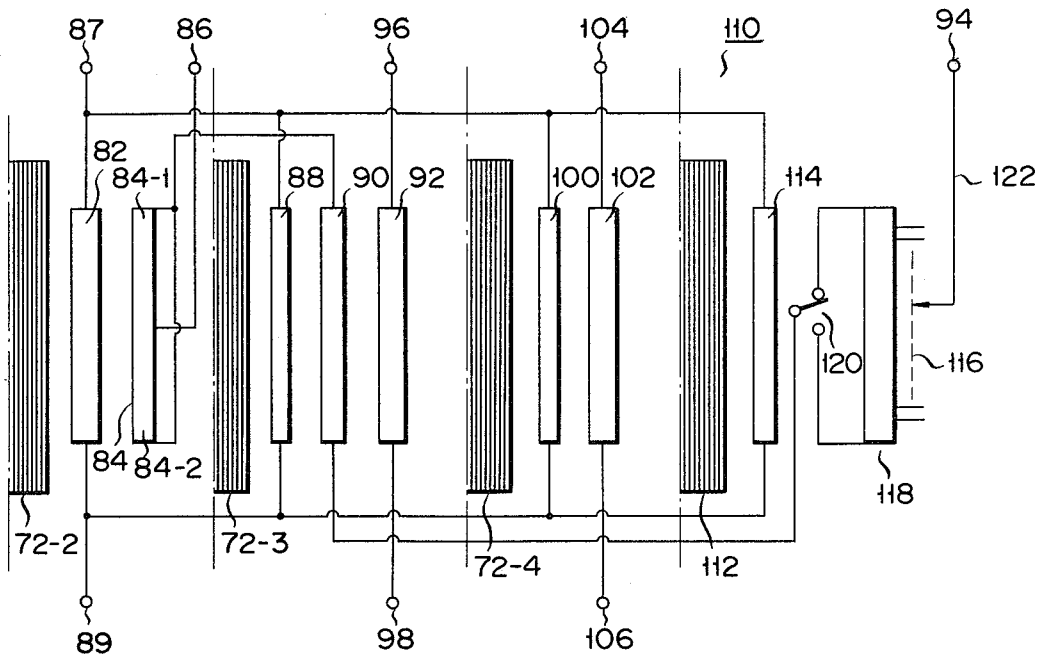
FIG. 11 is a schematic sectional drawing illustrating a transformer unit in accordance with another embodiment of the present invention.

FIG. 11 shows a transformer unit 110 in accordance with still another embodiment of the present invention. In FIG. 11, still another iron core leg 112 is included, a fourth coupling winding 114 is wound around the core leg 112, and the coupling winding 114 is connected in parallel with the first coupling winding 82 through a lead wire. A tap winding 118, from which a tap lead 116 is drawn out, is wound around the fourth coupling winding 114. A reversing switch 120 or a coarse tap selector (not shown) of the tap winding 118 is connected to the second primary winding 90, and the tap winding 118 and the primary winding 90 are connected in series. A tap switch 122 connected to the tap winding 118 is connected to the neutral point terminal 94. As shown in FIG. 11, with the transformer unit 110 wherein the tap winding 118 is included for adjusting the supply side AC voltage, the series-connected primary windings 84, 90 may be mounted on separate iron core legs 72-2, 72-3, and the secondary winding 102 and the primary windings 84, 90 may be coupled electromagnetically through the coupling windings 82, 88, 100, as shown in FIG. 7. In the example shown in the figure, the tap winding 118, unlike the other windings, is mounted on the separate iron core leg 112. However, it is obvious that the tap winding may be connected to one of the other legs 72-2, 72-3, 72-4, or the side legs 72-1, 72-5 without including particularly the iron core leg 112. Further, in the transformer units shown in FIGS. 6, 7, 9 and 11, one iron core 44 is received in one oil tank 45 and the winding units 76, 78 and 80 are mounted on respective iron core legs 72-2 through 72-4. However, the iron cores corresponding to respective iron core legs 72-2 through 72-4 may be housed in separate oil tanks, the winding units 76, 78 and 80 may be mounted on the corresponding iron cores, and the windings may be connected by wires, as shown in FIG. 7. In this case, the wiring between the windings may be disposed inside an oil duct connecting the oil tanks, or the windings may be mutually connected at terminals disposed outside the respective oil tanks. It is not necessary to dispose the respective winding units 76, 78 and 80 in totally separate oil tanks, but it is possible to receive the winding units 76, 78 in one oil tank and the winding unit 80 in another oil tank. The arrangement of these winding units with respect to the oil tanks may be varied according to the transporting and installing conditions as required.

What is claimed is:

1. A transformer unit for an AC-DC converter comprising:

a first core leg;

a first winding unit which is mounted on said first core leg and which includes a first primary winding and a first coupling winding electromagnetically coupled to said first primary winding;

a second core leg;

a second winding unit which is mounted on said second core leg and which includes a second primary winding connected in series with said first primary winding, a second coupling winding connected in parallel with said first coupling winding and electromagnetically coupled to said second primary winding, and a first secondary winding electromagnetically coupled to said second primary and coupling windings;

a third core leg; and a third winding unit which is mounted on said third core leg and which includes a third coupling winding connected parallel with said first coupling winding, and a second secondary winding electromagnetically coupled to said third coupling winding.

2. A transformer unit according to claim 1 wherein, in said first winding unit, said first primary winding is arranged outside the outer circumference of said first coupling winding.

3. A transformer unit according to claim 1 wherein, in said second winding unit, said second coupling winding is arranged inside and said first secondary winding is arranged outside with said second primary winding arranged therebetween.

4. A transformer unit according to claim 1 wherein, in said third winding unit, said second secondary winding is arranged outside the outer circumference of said third coupling winding.

5. A transformer unit according to claim 1 wherein said first, second and third core legs are disposed on a single iron core, and said first, second and third winding units are received with said iron core in a single oil tank.

6. A transformer unit according to claim 1 wherein said transformer unit further comprises:

a fourth core leg; and a fourth winding unit which is mounted on said fourth core leg and which includes a fourth coupling winding connected in parallel with said first coupling winding, and further includes tap windings electromagnetically coupled to said fourth coupling winding, said tap windings being connected in series with said second primary winding.

7. A transformer unit according to claim 1 wherein said first, second and third winding units are received in different oil tanks.

8. A transformer unit according to claim 1 wherein said two winding units are received in one oil tank, and the remaining winding unit is received in another oil tank.

9. A transformer unit according to claim 1 wherein said first winding unit includes line terminals connected to said first primary winding;

said second winding unit includes a neutral point terminal connected to said second primary winding, and line terminals connected to said first secondary winding; and said third winding unit includes line terminals connected to said second secondary winding.

10. A transformer according to claim 9 wherein one of said first, second and third winding units includes terminals connected to the coupling winding thereof.

* * * * *